US008919586B2

(12) United States Patent
Roodenburg et al.

(10) Patent No.: US 8,919,586 B2
(45) Date of Patent: Dec. 30, 2014

(54) HOISTING CRANE WITH HYBRID PORTIONS

(75) Inventors: Joop Roodenburg, Delft (NL); Hendrikus Jacobus Weterings, 's-Gravenzande (NL); Diederick Bernardus Wijning, Schiedam (NL)

(73) Assignee: ITREC B.V., Schiedam (NL)

( * ) Notice: Subject to any disclaimer, the term of this patent is extended or adjusted under 35 U.S.C. 154(b) by 527 days.

(21) Appl. No.: 12/989,104

(22) PCT Filed: Apr. 24, 2009

(86) PCT No.: PCT/NL2009/000103

§ 371 (c)(1),
(2), (4) Date: Jan. 31, 2011

(87) PCT Pub. No.: WO2009/131442

PCT Pub. Date: Oct. 29, 2009

(65) Prior Publication Data

US 2011/0114587 A1 May 19, 2011

(30) Foreign Application Priority Data

Apr. 25, 2008 (NL) ..... 2001522

(51) Int. Cl.

| | |
|---|---|
| ***B66C 23/00*** | (2006.01) |
| ***B66C 23/52*** | (2006.01) |
| ***B66C 23/64*** | (2006.01) |
| ***B66C 23/82*** | (2006.01) |

(52) U.S. Cl.

CPC ..... *B66C 23/52* (2013.01); *B66C 23/64* (2013.01); *B66C 23/82* (2013.01)

USPC ..... 212/347; 212/299; 212/177; 212/307

(58) Field of Classification Search

CPC ..... B66C 23/06; B66C 23/16; B66C 23/163; B66C 23/18; B66C 23/36; B66C 23/52; B66C 23/64; B66C 23/68; B66C 23/70; B66C 23/82; B66C 23/00; B66C 25/00; B66C 2700/01; B66C 2700/03

USPC ..... 212/175–177, 295–296, 298–299, 307, 212/347–348, 350, 232; 414/22.55, 543; 52/116, 117, 118, 119

See application file for complete search history.

(56) References Cited

U.S. PATENT DOCUMENTS

| | | | | |
|---|---|---|---|---|
| 2,432,528 | A | 12/1947 | Lively | |
| 3,323,660 | A * | 6/1967 | Allin, Sr. | 212/177 |
| 4,253,579 | A * | 3/1981 | Williams | 52/650.2 |
| 5,487,479 | A * | 1/1996 | Pech et al. | 212/270 |
| 6,279,764 | B1 | 8/2001 | Stoof | |
| 6,871,469 | B2 * | 3/2005 | Lissandre et al. | 52/633 |
| 7,328,811 | B2 | 2/2008 | Roodenburg et al. | |
| 2002/0053550 | A1 * | 5/2002 | Stoof | 212/176 |

FOREIGN PATENT DOCUMENTS

| | | | |
|---|---|---|---|
| CN | 1212667 | A | 3/1999 |
| CN | 1976866 | A | 6/2007 |
| DE | 11 29 269 | | 10/1957 |
| WO | 97/31855 | A1 | 9/1997 |
| WO | 2005/123566 | A | 12/2005 |

* cited by examiner

*Primary Examiner* — Sang Kim
*Assistant Examiner* — Nathaniel Adams
(74) *Attorney, Agent, or Firm* — Birch, Stewart, Kolasch & Birch, LLP

(57) ABSTRACT

Hoisting crane (20), comprising a substantially hollow jib (24,-124; 324) having a longitudinal axis, and comprising one or more hoisting cable guides (47, 48, 49; 147; 347). The jib comprises at least one jib leg (29; 129; 329) extending between a jib connection member (26) and a jib hoisting end (27; 127; 327), wherein the at least one jib leg comprises one or more hybrid portions (160; 360) comprising two elongated hollow casings (170; 370) substantially parallel to each other and substantially parallel to the longitudinal axis of the jib, and wherein between the two casings a truss (171 371) is provided to rigidly connect the two castings.

7 Claims, 8 Drawing Sheets

HOISTING CRANE WITH HYBRID PORTIONS

Figure 1:
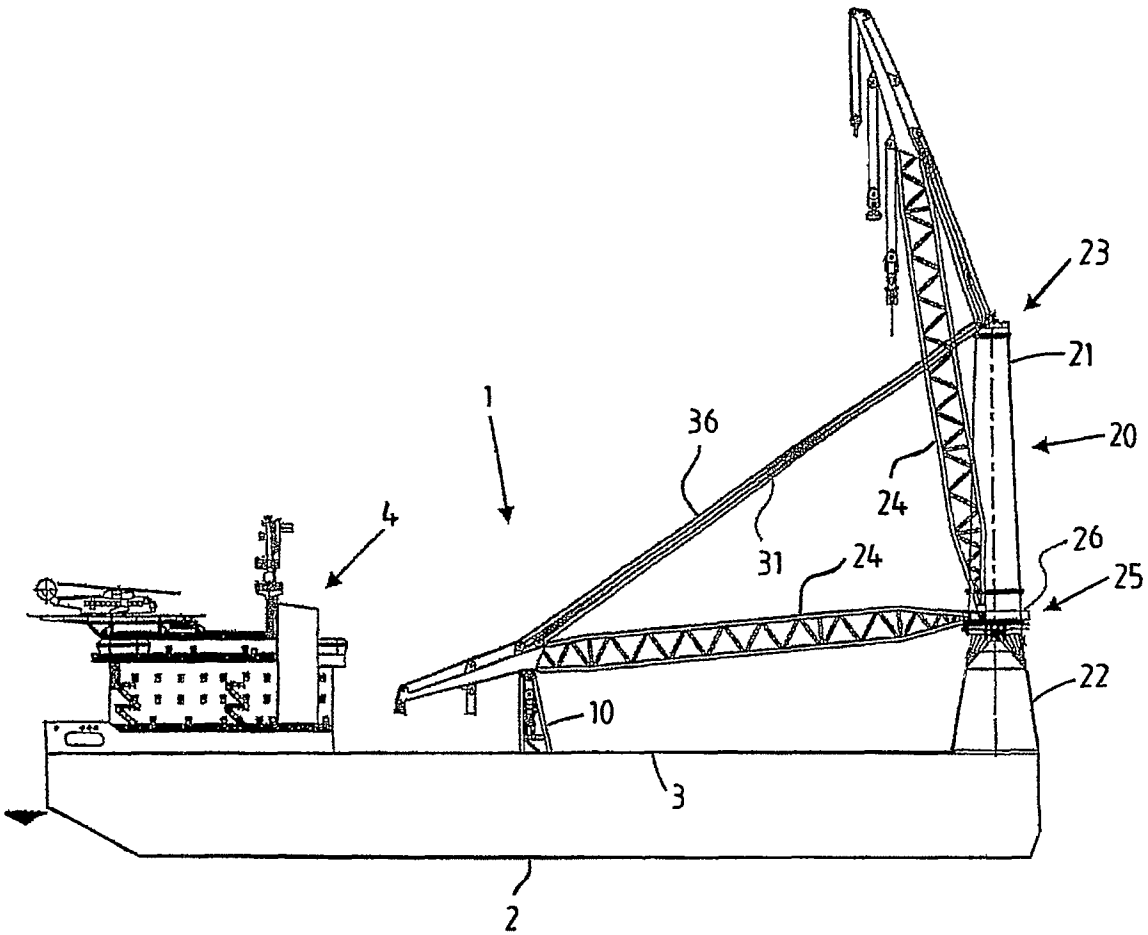
Fig.1 ( prior art )

The invention relates to a hoisting crane comprising:

a substantially hollow vertical column with a foot which is or can be fixed to a support, and with a top, a substantially hollow jib having a longitudinal axis, and comprising one or more hoisting cable guides, an annular bearing structure, which extends around the column and guides and carries a jib connection member, so that the jib connection member can rotate about the column, the jib connection member forming a substantially horizontal pivot axis perpendicular to the longitudinal axis of the jib, so that the jib can be pivoted up and down, topping means for pivoting the jib up and down, comprising a jib winch and a jib hoisting cable, hoisting means for hoisting a load, comprising a hoisting winch and an associated hoisting cable; the hoisting winch being disposed in the column, preferably in the vicinity of the foot of the column, so that the hoisting cable extends from the hoisting winch through the hollow vertical column to a top cable guide at the top of the column and then to at least one of the hoisting cable guides on the jib, wherein the jib comprises at least one jib leg extending between the jib connection member and a jib hoisting end. Such hoisting cranes are made by the applicant for years.

Two of the main demands for the design of the hoisting crane are that the hoisting crane is as light as possible and at the same time is strong enough to withstand mechanical loads due to hoisting the load. It is a challenge to find the best compromise between these two demands.

It is an object of the invention to provide an improved design of the hoisting crane.

The invention therefore provides a hoisting crane, characterized in that the at least one jib leg comprises one or more hybrid portions each comprising two elongated hollow casings substantially parallel to each other and substantially parallel to the longitudinal axis of the jib, and wherein between the two casings a truss is provided to rigidly connect the two casings.

Preferably, two jib legs are provided of substantially equal length extending between the jib connection member and the jib hoisting end. The two jib legs may form an A-frame. Preferably, the elongated hollow casings have a substantially rectangular cross section and each side of the substantially rectangular cross section comprises at least one plate. It is also possible that at least one side is substantially vaulted to stiffen the casing. In another embodiment, the cross section of the elongated hollow casings has rounded corners and/or is substantially oval shaped.

Due to hoisting of the load, mechanical loads occur in the jib, such as bending moments, shear forces, and torques. The bending stiffness of the jib is determined by the material properties and the area moment of inertia. In particular, the higher the area moment of inertia the stiffer. A high area moment of inertia is obtained when material is located far away from the centre of area. The two elongated hollow casings are therefore located at opposite sides of the centre of area to contribute as much as possible to the bending stiffness. In practice, the two casings have to be rigidly connected to each other in order to prevent shearing of the portion. This is done by a truss which has the advantage that it is a light weight solution to rigidly connect the two casings. With this design, the hybrid portion is configured such that the bulk material is mainly located where it is used most effectively and less at the locations where the contribution to the overall strength is relatively low, and thereby lowers the weight of the jib while remaining strong enough for hoisting a load.

An additional advantage of the truss may be that wind flowing between the casings has a minimal interaction with the truss and therefore, wind has a minimal influence on the jib compared to a jib made of casings only.

Yet another advantage of the jib according to the invention may be that the jib is less sensitive to fatigue and easier accessible for maintenance purposes compared to a jib made of trusses only.

The two casings are hollow to further decrease the weight while maintaining a sufficient torsional strength of the hybrid portion.

Preferably, each jib leg comprises one or more hybrid portions at the regions where the bending moments are maximal.

In an embodiment, the elongated hollow casings are parallel to a plane defined by the substantially horizontal pivot axis and the longitudinal axis of the jib, so that the jib can withstand the most common bending moments. An additional advantage is that the space between the two casings forms a walkway, for instance for maintenance people.

Preferably, the cross section, which is mainly perpendicular to the longitudinal axis of the jib, of the hybrid portion is substantially rectangular, wherein the two elongated hollow casings form two opposed sides of the substantially rectangular cross section.

In another embodiment, the truss is formed by two sets of beams, which form the two other opposed sides of the substantially rectangular cross section of the hybrid portion. This has the advantage that the torsional strength of the portion is increased. This can be advantageous when relatively high torques are applied to the jib.

Preferably, the elongated hollow casings of the hybrid portion comprise one or more plate portions at least one of which extending beyond the hollow casing, and wherein the truss comprises one or more beams, at least one of which is connected to the at least one plate portion extending beyond the hollow casing. This extension makes it easier to connect the truss to the casing by for instance welding or screwing. In case of welding, the extension also makes it possible to have welding joints on both sides of the extending side wall, thereby making the connection stronger. Other connection methods are also conceivable.

Preferably, the beams forming the truss between two casings are positioned such that a casing and two beams together form a triangle. A triangle is advantageous to prevent shearing of a portion and rigidly connect the two casings. Preferably, they form a substantially equilateral triangle. This has the advantage that all beams can be similar dimensioned and will equally contribute to the strength of the portion.

In case of two provided jib legs, the two jib legs may be connected to each other by one or more elongated hollow connection members oriented mainly parallel to the substantially horizontal pivot axis. This improves the strength of the structure in a direction parallel to said horizontal pivot axis. It is also conceivable that the connection members comprise one or more hybrid portions comprising two elongated hollow casings substantially parallel to each other and substantially parallel to the substantially horizontal pivot axis, and wherein between the two casings a truss is provided to rigidly connect the two casings. This in particular increases the bending stiffness of the structure about the longitudinal axis.

The invention also relates to a vessel provided with a hoisting crane as described above and to a jib suitable for a hoisting crane as described above.

The invention further relates to a substantially hollow jib applicable for any type of crane suitable for hoisting loads, including the abovementioned hoisting crane. Preferably the jib has a minimal length of 40 m. The jib has a longitudinal axis and a substantially horizontal pivot axis perpendicular to the longitudinal axis and comprises one or more hoisting cable guides, a jib hoisting end, and two jib legs of substantially equal length extending between the substantially horizontal pivot axis and the jib hoisting end, wherein the jib legs further comprise one or more hybrid portions comprising two elongated hollow casings substantially parallel to each other and substantially parallel to the longitudinal axis of the jib, and wherein between the two casings a truss is provided to rigidly connect the two casings.

A jib configured like this has the advantage that the bulk material is mainly located where it is used most effectively and less at the locations where the contribution to the overall strength is low, and thereby lowers the weight of the jib while remaining strong enough for hoisting a relatively heavy load. In a preferred embodiment, the hybrid portion has a substantially rectangular cross section. The elongated hollow casings may be parallel to a plane defined by the substantially horizontal pivot axis and the longitudinal axis.

Preferably, the elongated hollow casings have a substantially rectangular cross section and each side of the substantially rectangular cross section comprises at least one plate. It is also possible that at least one side of the substantially rectangular cross section of the casing is substantially vaulted to stiffen the casing. In another embodiment, the cross section of the elongated hollow casings has rounded corners and can even be substantially oval shaped.

The invention also relates to a jib suitable for any kind of crane, comprising one or more hybrid portions comprising two elongated casings substantially parallel to each other and substantially parallel to a longitudinal axis of the jib, and wherein between the two casings a truss is provided to rigidly connect the two casings.

It is to be understood that features applying to the jib of the aforementioned hoisting crane also apply mutatis mutandis to the abovementioned more generally described jibs and vice versa.

Embodiments of the invention will now be described in a non-limiting way with reference to the drawing.

Figure 2:
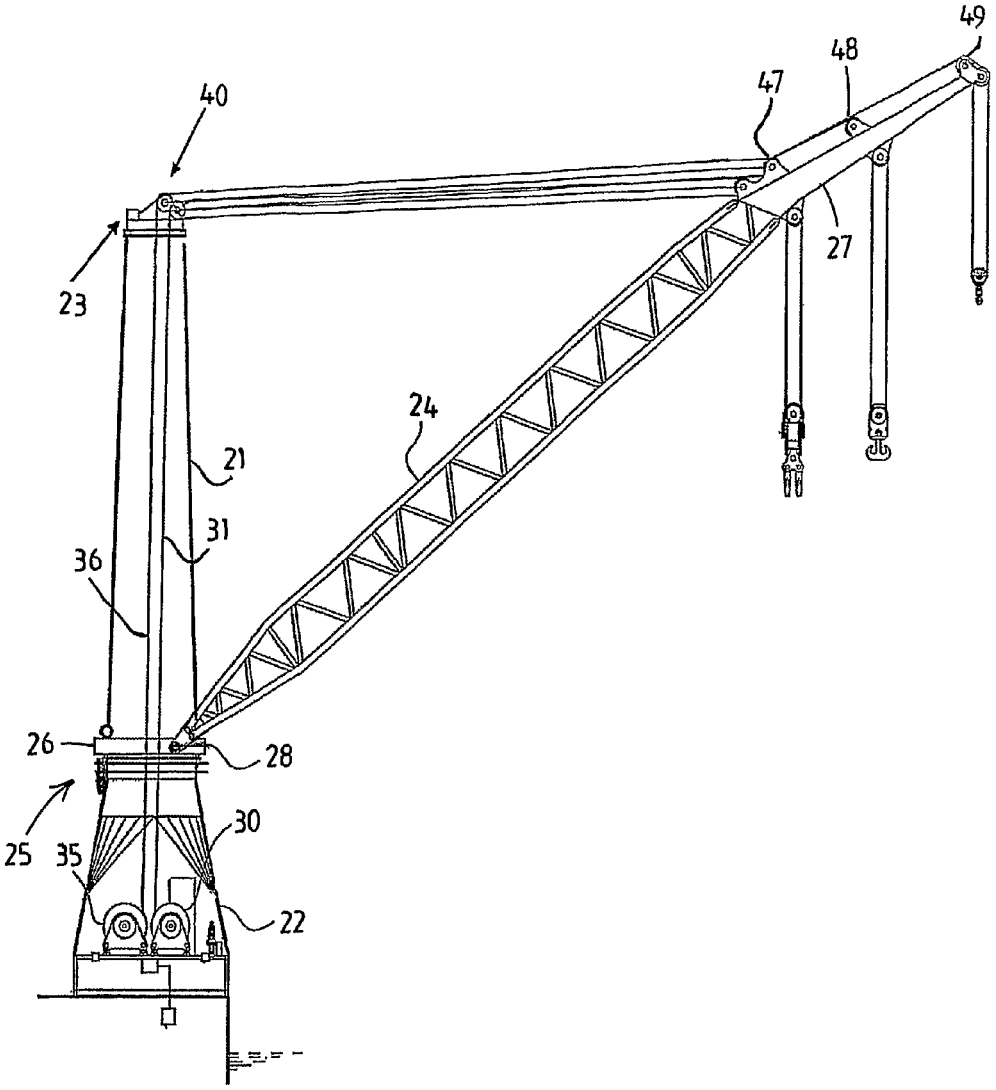
Fig.2 ( prior art )
Figure 3:
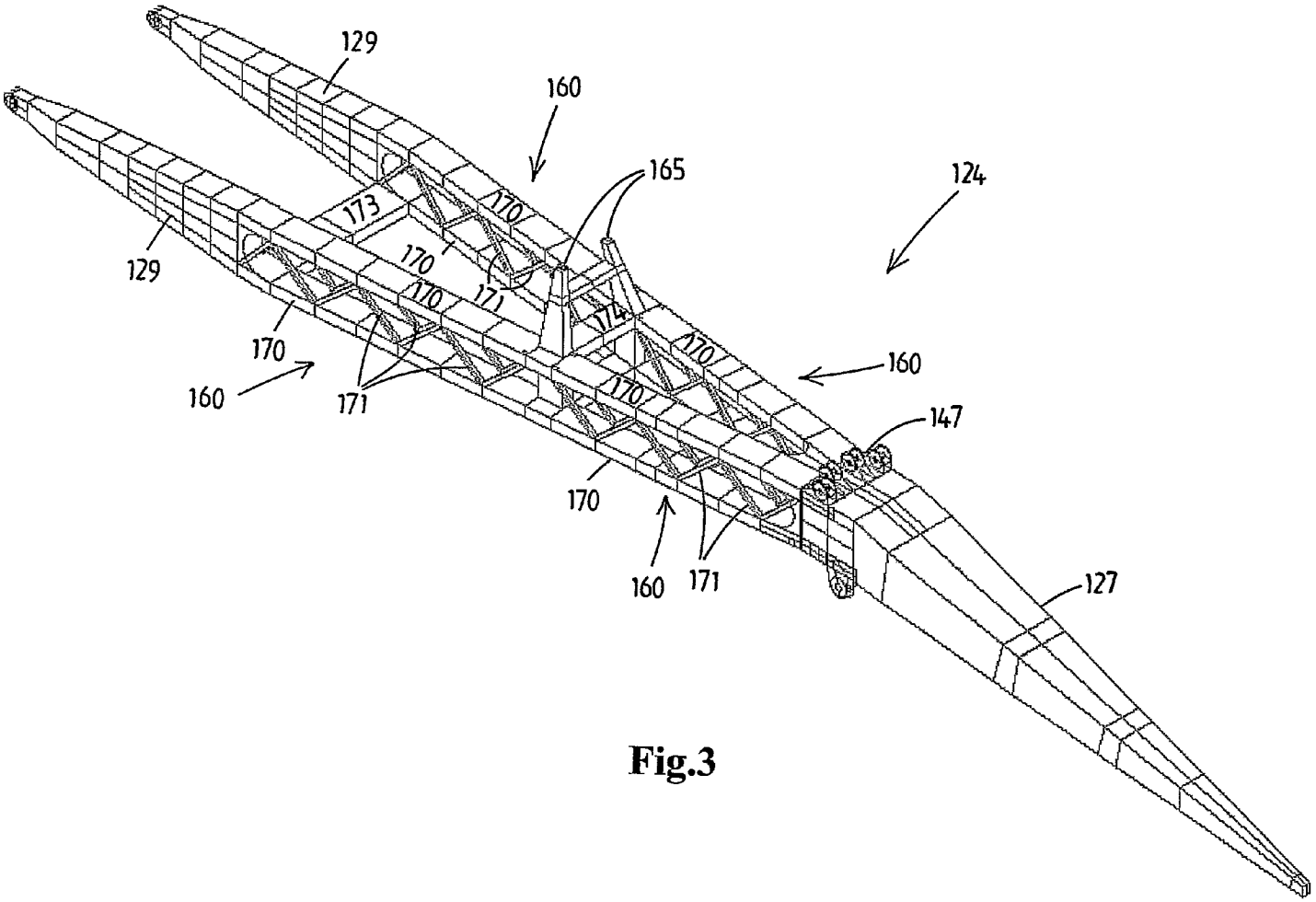
Figure 4:
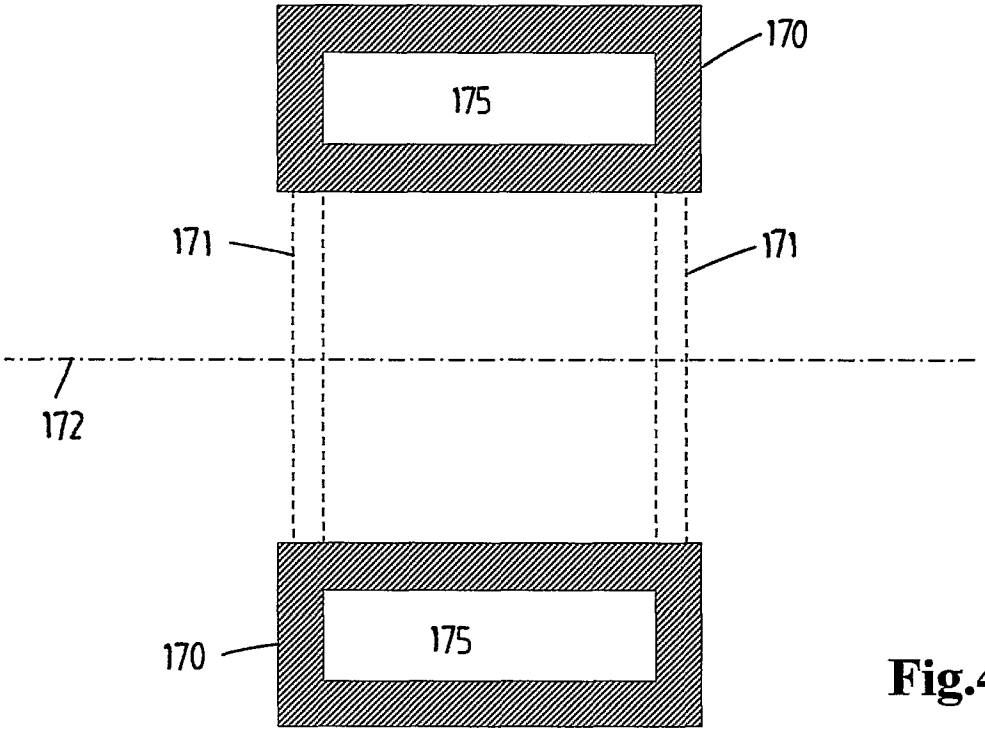
Figure 5:
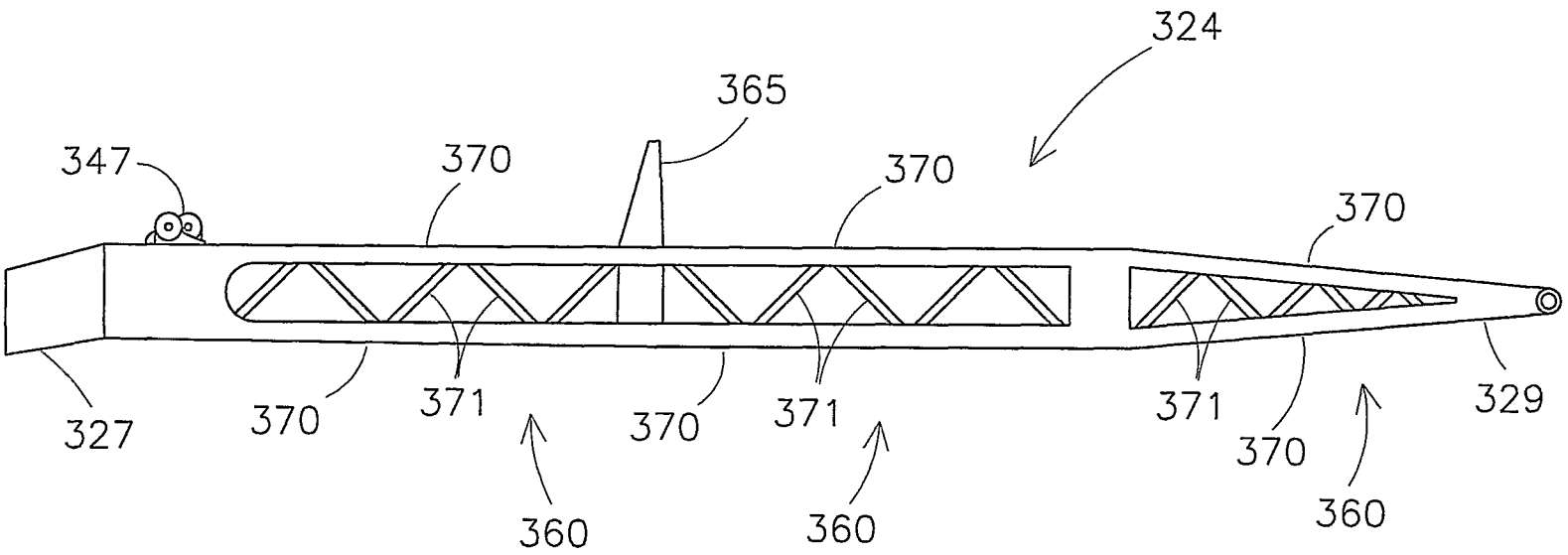
Figure 6:
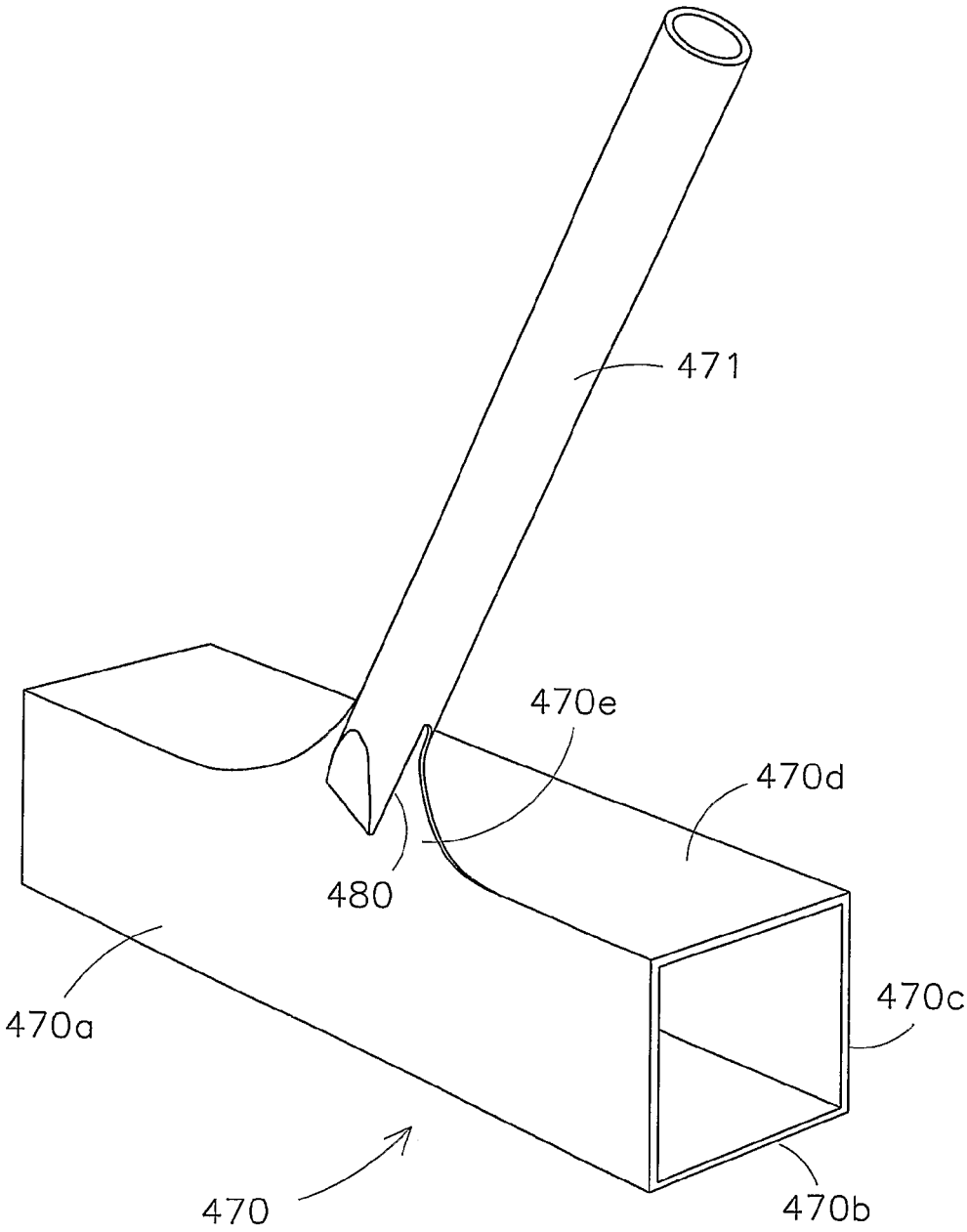
Figure 7:
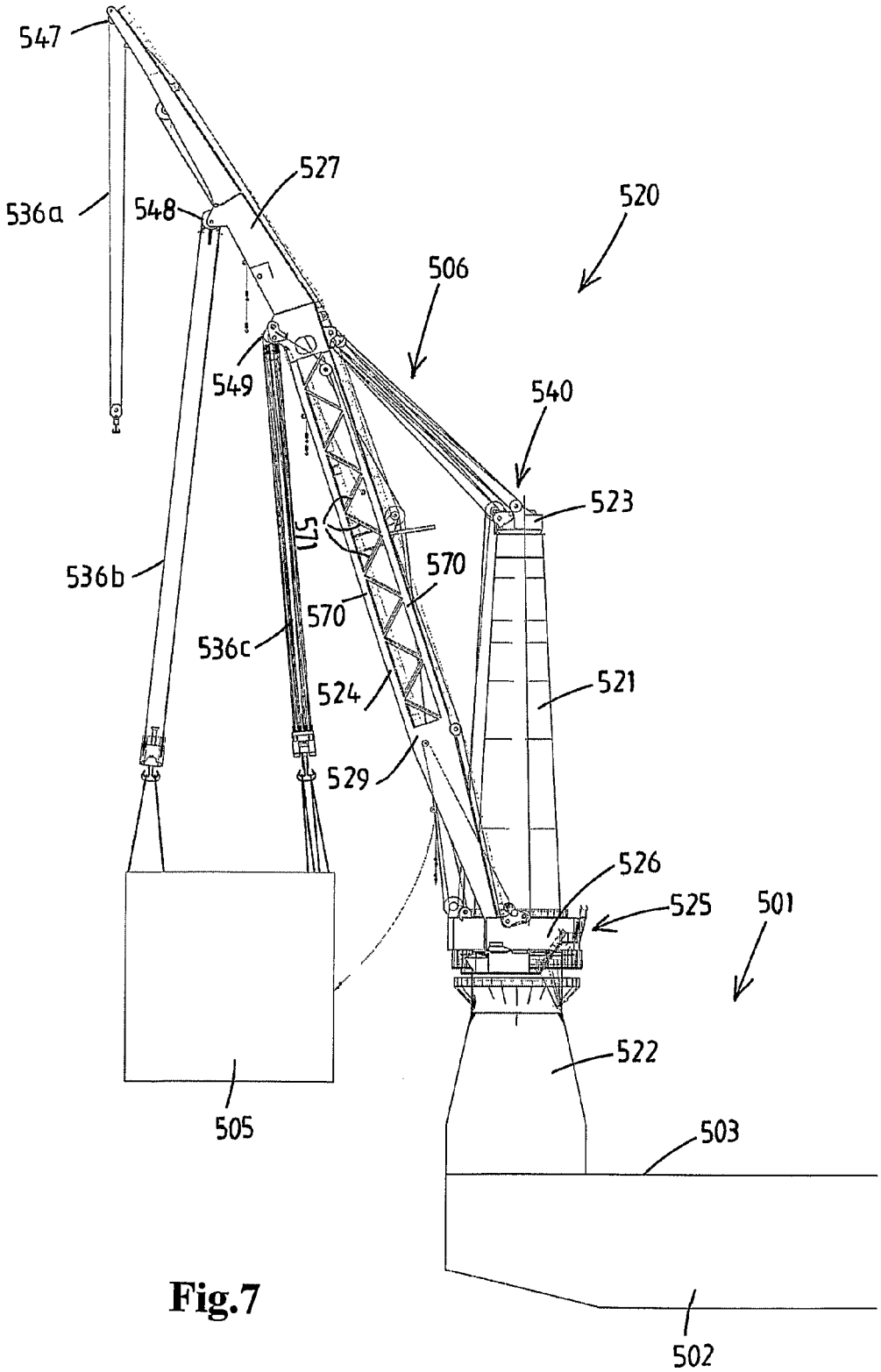
Figure 8:
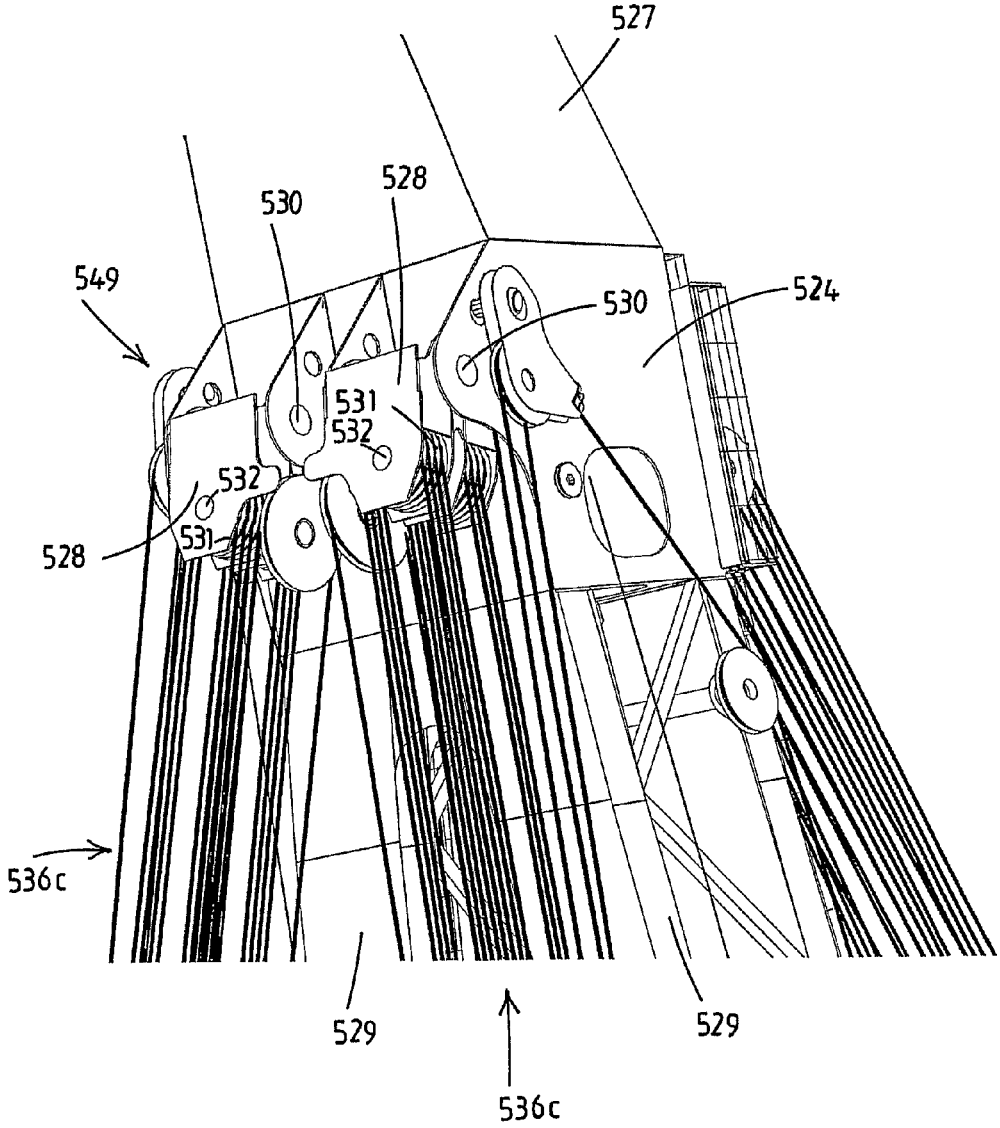

In the drawing:

FIG. 1 diagrammatically depicts a vessel with a prior art hoisting crane in two positions, FIG. 2 shows the prior art hoisting crane of FIG. 1, partially in the form of a cut-away view, FIG. 3 shows a jib according to an embodiment of the invention in perspective, FIG. 4 is a cross sectional view of the jib of FIG. 3, FIG. 5 shows a side view of a jib according to another embodiment of the invention, and FIG. 6 shows in perspective a detail of a jib according to a further embodiment of the invention, FIG. 7 shows a vessel with a hoisting crane according to yet another embodiment of the invention, FIG. 8 shows an enlarged detail of the hoisting crane of FIG. 7.

FIG. 1 schematically shows a vessel 1 with a prior art hoisting crane 20 according to the preamble of claim 1. The vessel 1 comprises a hull 2 with a working deck 3 and, at the front of the hull 2, a superstructure 4 for crew accommodation, etc.

Furthermore, the vessel 1 has a hoisting crane 20, in this example disposed at the rear end of the hull 2. The prior art hoisting crane 20 which is illustrated in detail in FIG. 2, has a substantially hollow vertical column 21 with a foot 22, which is here fixed to the hull 2 of the vessel 1. Furthermore, the column 21 has a top 23.

The hoisting crane 20 has a jib 24, which is illustrated in two different positions in FIG. 1. The jib 24 is provided with hoisting cable guides 47, 48, 49 to guide hoisting cables at a hoisting end 27 of the jib 24. An annular bearing structure 25 extends around the vertical column 21 which guides and carries a jib connection member 26, so that the jib connection member 26, and therefore the jib 24, can rotate about the vertical column 21.

In this case, the jib connection member 26 forms a substantially horizontal pivot axis 28, so that the jib 24 can also be pivoted up and down. A jib rest 10 is mounted on the hull 2 to support the jib 24 when the hoisting crane 20 is not in operation, which position is also shown in FIG. 1. The jib rest 10 shown in FIG. 1 is very schematic, and will not be explained in further detail.

To pivot the jib 24 up and down, topping means are provided comprising a jib winch 30 and a jib hoisting cable 31 which engages with the jib 24. Furthermore, the hoisting crane 20 comprises a hoisting winch 35 for raising and lowering a load, with an associated hoisting cable 36. At the top 23 of the column 21 there is a top cable guide 40 to guide the jib hoisting cable 31 and the hoisting cable 36. Preferably, the top cable guide 40 is able to rotate with the jib about a longitudinal axis of the column, so that the to cable guide can be aligned with the jib independent of an angular position of the jib.

The jib hoisting winch 30 and the hoisting winch 35 are disposed in the column 21, preferably in the vicinity of the foot 22 of the column 21, so that the jib hoisting cable 31 and the hoisting cable 36 extend from respectively the jib hoisting winch 30 and the hoisting winch 35 through the hollow vertical column 21 to the top cable guide 40 and then to the jib 24. The jib 24 is provided with hoisting cable guides 47, 48 and 49 to guide the hoisting cables at the hoisting end 27 of the jib 24.

It is noted here that the jib of the prior art hoisting crane of FIGS. 1 and 2 has a portion that is completely formed by a truss with beams and thus does not represent an optimal design of the hoisting crane.

FIG. 3 depicts a jib 124 according to the invention in perspective. The jib 124 comprises a hoisting end 127 and two jib legs 129. A jib 124 with one jib leg 129 is also conceivable. The two jib legs 129 have substantially the same length and one end of each jib leg 129 is connectable to a connection member (not shown in FIG. 3) which defines a substantially horizontal pivot axis to pivot the jib about. The opposite ends of jib legs 129 are connected to the hoisting end 127.

Each jib leg 129 comprises a hybrid portion 160 with, in this embodiment, a substantially rectangular cross section. Two elongated hollow casings 170 form two opposite sides of the cross section of the hybrid portion 160. The two casings 170 in this embodiment also have a substantially rectangular cross section. In between the casings 170, a truss with beams 171 is arranged to rigidly connect the two casings 170 together. In FIG. 3 only some beams of the truss are designated by reference numeral 171. Other portions of the jib 124 of this embodiment, such as the portions between the hybrid portions 160 and the point where jib 124 is connectable to the substantially horizontal pivot axis, and the hoisting end 127, are substantially hollow.

In this example a hoisting cable guide 147 is arranged on the hoisting end 127, but it is also conceivable that more hoisting cable guides are arranged on the hoisting end 127, as for example shown in FIG. 2.

FIG. 3 also shows connection members 173 and 174 that form additional connections between the two jib legs 129. This provides a stiffer construction in a direction parallel to substantially horizontal pivot axis. It is also conceivable that connection members 173 and 174 are formed by a truss with beams. Preferably, the connection members 173 and 174 comprise a hybrid portion 160. Jib 124 further comprises jib connection means 165 where a jib hoisting cable is connectable to the jib 124.

FIG. 4 shows a cross section of a hybrid portion 160 of FIG. 3, perpendicular to the longitudinal axis of the jib 124. The cross section of the hybrid portion 160 in this embodiment has a substantially rectangular shape, wherein two opposite sides of the rectangular shape are formed by two elongated hollow casings 170 defining hollow spaces 175. It is conceivable that the hollow spaces 175 comprise strengthening ribs or other strengthening structures. Also, other shapes for hollow spaces 175 can be used, for instance, a more oval shape. In this embodiment, the casings 170 each have four side walls. Alternatively, it is also possible that at least one of the four walls is substantially vaulted to stiffen the wall. It is also conceivable that the cross section of the elongated hollow casings has rounded corners and can even be substantially oval shaped. The hollow space 175 keeps the weight low while the casing 170 is still able to withstand a torsional load.

In between the two casings 170, a truss with beams 171 is arranged to connect the casings 170 such that the casings 170 and the truss with beams 171 form a rigid body.

Parallel to the casings 170 and through the centre of area, a central axis 172 is drawn. The bending stiffness about the central axis 172 of the hybrid portion 160 depends on the area moment of inertia about the central axis 172. Material located further away from the central axis 172 will contribute more to the bending stiffness than material located near the central axis 172. The casings 170 are therefore the parts that provide most of the bending stiffness to the portion.

The jib 124 does not only experience bending moments, but also shear forces and torques which may be applied to the hybrid portion 160. If the two casings 170 are not rigidly connected to each other, shear forces still result in large deformations of the hybrid portion 160. The truss with beams 171 thus prevents large deformations of the hybrid portion 160 by connecting the casings 170. In FIG. 3, and also in the cross sectional view of FIG. 4, the truss is formed by two sets of beams 171 forming the other opposite sides of the rectangular cross section of the hybrid portion 160. This has the advantage that the torsional strength of the hybrid portion 160 is increased. Depending on the mechanical loads on the jib 124, other truss configurations are also possible. For instance, beams that cross diagonally from one side of the cross section of the hybrid portion 160 to the opposite side. It is also conceivable that the beams 171 cross each other.

The advantage of the truss with beams 171 in between the casings 170 is that it reduces the weight of the hybrid portion 160, while the hybrid portion 160 remains strong enough to withstand the different mechanical loads applied to the hybrid portion 160.

It is also conceivable that the casings form the other two opposed sides of the substantially rectangular cross section of the hybrid portion. Such a hybrid portion has a relatively high bending stiffness about a central axis that is perpendicular to the horizontal pivot axis and the longitudinal axis of the jib.

In a side view of another embodiment of the invention, shown in FIG. 5, a partial jib 324 is shown with a hoisting end 327 and jib leg 329. The jib leg 329 is on one end connected to hoisting end 327 and on the other end connectable to a jib connection member (not shown), to pivot about a substantially horizontal pivot axis. This embodiment shows that it is possible that almost the entire jib leg 329 comprises hybrid portions 360 with two elongated casings 370 and in between a truss with beams 371. In FIG. 5, only some beams of the truss are designated by reference numeral 371. An additional advantage of the truss with beams 371 is that the cross sectional area is small compared to a solid wall of a casing-like structure and wind mainly parallel to the substantially horizontal pivot axis 28 has a relatively small influence on the jib 324.

The jib 324 further comprises a hoisting cable guide 347 and jib connection means 365 where a jib hoisting cable is connectable to the jib 324 (not shown).

This side view also clearly shows that two beams 371 of the truss and a casing 370 form a triangle. Here as preferred, an equilateral triangle. Other configurations are also possible, but a triangular shape is preferred, since this shape is known to have a high resistance to bending, twisting and shear.

The equilateral triangle shape further has the advantage that beams 371 can be dimensioned substantially the same, which has fabrication and assembly advantages, and thereby the contribution of each beam 371 to the strength of the hybrid portion 360 is substantially equal.

FIG. 6 shows a possible connection between a beam 471 of a truss and a casing 470. The casing 470 comprises four plate portions 470*a*, 470*b*, 470*c*, and 470*d*. Plate portion 470*a* has an extension 470*e* extending outside the rectangular cross section defined by plate portion 470*a*, 470*b*, 470*c*, and 470*d*. In this case, the extension is a locally wider plate portion 470*a*. Further shown in FIG. 6 is part of a truss in the form of a beam 471 with a groove wherein extension 470*e* fits. This embodiment shows a connection made by welding. A welding joint 480 is made to connect the beam 471 to extension 470*e*. The extension 470*e* makes it possible to make a similar welding joint at the other side of the extension 470*e* (not shown). This has the advantage that the connection is stronger than in the case of only a welding joint at one side. Other connection methods are also conceivable, for instance a screwed joint. The extension 470*e* then makes it easier to access the screwed joint and thus simplifies the assembly and maintenance.

FIG. 7 shows a vessel 501 with a hoisting crane 520 according to an embodiment of the invention. The vessel 501 comprises a hull 502 with a working deck 503.

The hoisting crane 520, in this example disposed at the rear end of the hull 502, has a substantially hollow vertical column 521 with a foot 522, which is here fixed to the hull 502 of the vessel 501. Furthermore, the column 521 has a top 523.

The hoisting crane 520 has a jib 524. The jib 524 is provided with hoisting cable guides 547, 548, 549 to guide hoisting cables at a hoisting end 527 of the jib 524. An annular bearing structure 525 extends around the vertical column 521 which guides and carries a jib connection member 526, so that the jib connection member 526, and therefore the jib 524, can rotate about the vertical column 521.

In this case, the jib connection member 526 forms a substantially horizontal pivot axis (not shown), so that the jib 524 can also be pivoted up and down. To pivot the jib 524 up and down, topping means 506 are provided comprising a jib winch (not shown) and a jib hoisting cable which engages with the jib 524. Furthermore, the hoisting crane 520 comprises multiple hoisting winches (not shown) and respective hoisting cables 536A, 536B, 536C for raising and lowering a load, in this case a load 505 using hoisting cables 536B and 536C. At the top 523 of the column 521 there is a top cable guide 540 to guide the jib hoisting cable and the hoisting cables.

The jib hoisting winch and the hoisting winches are disposed in the column 521, preferably in the vicinity of the foot 522 of the column 521, so that the jib hoisting cable and the hoisting cables extend from respectively the jib hoisting winch and the hoisting winches through the hollow vertical column 521 to the top cable guide 540 and then to the jib 524. The jib 524 is provided with hoisting cable guides 547, 548 and 549 to guide the hoisting cables at the hoisting end 527 of the jib 524.

For simplicity reasons, the jib hoisting cable and hoisting cables will not be described in further detail as there are many ways of guiding the cables from the jib 524 to the respective jib winch and hoisting winches, as known to the skilled person in the art. Possible configurations include a direct guiding from the hoisting end 527 to the top cable guide 540 or an indirect guiding via the jib connection member 526 to decrease the moments applied to the jib 524 by the cables during hoisting of the load.

The jib 524 comprises the hoisting end 527 and two jib legs 529 of which only one is shown in FIG. 7 from the side. A jib 524 with one jib leg 529 is also conceivable. The two jib legs 529 have substantially the same length and a lower end of each jib leg 529 is connected to the connection member 526 to pivot around the substantially horizontal pivot axis. The opposite ends of jib legs 529 are connected to the hoisting end 527.

Each jib leg 529 comprises a hybrid portion with, in this embodiment, a substantially rectangular cross section. Two elongated hollow casings 570 form two opposite sides of the cross section of the hybrid portion. The two casings 570 in this embodiment also have a substantially rectangular cross section. In between the casings 570, a truss with beams 571 is arranged to rigidly connect the two casings 570 together. In FIG. 7 only some beams of the truss are designated by reference numeral 571.

As the hoisting crane 520 comprises multiple hoisting cables 536 A, 536B, 536C and respective hoisting winches and hoisting cable guides 547, 548, 549, these hoisting means can be combined to hoist the load 505 as is for example shown in FIG. 7. Both the hoisting cables 536B and 536C are attached to the load 505 to hoist the load 505. The respective hoisting cable guides 548 and 549 are pivotable to allow the hoisting cables to be at an angle with the vertical in order to increase the operational flexibility of the hoisting crane. If the hoisting cable guides do not allow the hoisting cables to be at an angle with the vertical, this limits the way the hoisting cables are connected to the load, as only vertical aligned hoisting cables are allowed.

Hoisting cable guide 549 is shown in more detail in FIG. 8. FIG. 8 shows a part of the jib 524, in particular an intermediate member 524 connecting the jib legs 529 to the hoisting end 527. The intermediate member 524 comprises the hoisting cable guide 549 which guides the hoisting cables 536C.

In this embodiment, the hoisting cable guide 549 comprises two pulley blocks 528 each comprising multiple pulley sheaves 531 which are rotatable about an associated rotation axis 532.

The pulley blocks 528 are pivotable about a substantially horizontal pivot axis 530 which is substantially parallel to the horizontal pivot axis defined by the jib connection member 526 about which the jib is able to pivot. This allows the hoisting cables 536C to be at an angle to the vertical without undesired loads on the pulley sheaves and/or pulley blocks during hoisting and thus increases the number of ways the hoisting cables can be connected to a load.

The invention claimed is:

1. A substantially hollow jib for a hoisting crane, the jib having a longitudinal axis and a substantially horizontal pivot axis perpendicular to the longitudinal axis comprising:

one or more hoisting cable guides;

a jib hoisting end; and two jib legs of equal length extending between the substantially horizontal pivot axis and the jib hoisting end, wherein each of the two jib legs comprises one or more hybrid portions comprising two elongated hollow casings substantially parallel to each other and substantially parallel to the longitudinal axis of the jib, wherein between the two casings a truss is provided to rigidly connect the two casings, wherein the two elongated casings are a top hollow casing and a bottom hollow casing, wherein the elongated hollow casings are parallel to a plane defined by the substantially horizontal pivot axis and the longitudinal axis of the jib, wherein a cross section of the hybrid portion mainly perpendicular to the longitudinal axis of the jib is substantially rectangular, wherein the two elongated hollow casings form two opposed sides of the substantially rectangular cross section of the hybrid portion, and wherein the truss is formed by two sets of beams arranged at a distance from each other in a direction parallel to the horizontal pivot axis, each set of beams forming one of the other two opposed sides of the substantially rectangular cross section of the hybrid portion.

2. A hoisting crane, comprising:

a substantially hollow vertical column with a foot, which is or can be fixed to a support, and with a top;

a substantially hollow jib having a longitudinal axis, and comprising one or more hoisting cable guides;

an annular bearing structure, which extends around the column and guides and carries a jib connection member, so that the jib connection member can rotate about the column, the jib connection member forming a substantially horizontal pivot axis perpendicular to the longitudinal axis of the jib, so that the jib can be pivoted up and down;

a topping device configured to pivot the jib up and down, comprising a jib winch and a jib hoisting cable; and a hoisting device configured to hoist a load, comprising a hoisting winch and an associated hoisting cable, the hoisting winch being disposed in the column, so that the hoisting cable extends from the hoisting winch through the hollow vertical column to a top cable guide at the top of the column and then to at least one of the hoisting cable guides on the jib, wherein the jib comprises two jib legs of equal length extending between the jib connection member and a jib hoisting end, wherein each of the two jib legs comprises one or more hybrid portions comprising two elongated hollow casings substantially parallel to each other and substantially parallel to the longitudinal axis of the jib, wherein between the two casings a truss is provided to rigidly connect the two casings, wherein the two elongated hollow casings are a top hollow casing and a bottom hollow casing, wherein the elongated hollow casings are parallel to a plane defined by the substantially horizontal pivot axis and the longitudinal axis of the jib, wherein a cross section of the hybrid portion mainly perpendicular to the longitudinal axis of the jib is substantially rectangular, wherein the two elongated hollow casings form two opposed sides of the substantially rectangular cross section of the hybrid portion, and wherein the truss is formed by two sets of beams at a distance from each other in a direction parallel to the horizontal pivot axis, each set of beams forming one of the other two opposed sides of the substantially rectangular cross section of the hybrid portion.

3. The hoisting crane according to claim 2, wherein the elongated hollow casings of the hybrid portion comprise one or more plate portions at least one of which extending beyond the hollow casing for connection to one or more respective beams of the two sets of beams of the truss.

4. The hoisting crane according to claim 2, wherein the one or more hoisting cable guides are pivotally connected to the jib about a substantially horizontal pivot axis.

5. A vessel provided with a hoisting crane according to claim 2.

6. The hoisting crane according to claim 2, wherein the two jib legs are connected to each other by one or more elongated hollow connection members oriented mainly parallel to the substantially horizontal pivot axis.

7. The hoisting crane according to claim 6, wherein the connection members comprise one or more additional hybrid portions comprising two additional elongated hollow casings substantially parallel to each other and substantially parallel to the substantially horizontal pivot axis, and wherein between the two additional casings another truss is provided to rigidly connect the two additional casings.

* * * * *